United States Patent [19]

Mabry

[11] Patent Number: 4,995,459

[45] Date of Patent: Feb. 26, 1991

[54] ROD GUIDE/PARAFFIN SCRAPER

[76] Inventor: John F. Mabry, 307 E. 24 Court, Owasso, Okla. 74055

[21] Appl. No.: 207,492

[22] Filed: Jun. 16, 1988

[51] Int. Cl.[5] ..... E21B 37/02

[52] U.S. Cl. ..... 166/176

[58] Field of Search ..... 166/170, 173, 176, 177, 166/242

[56] References Cited

U.S. PATENT DOCUMENTS

| | | | |
|---|---|---|---|
| 3,058,524 | 10/1962 | Tripplehorn | 166/176 |
| 3,438,404 | 4/1969 | Tripplehorn | 166/176 |
| 3,537,519 | 11/1970 | Long | 166/176 X |
| 4,589,483 | 5/1986 | Sable | 166/176 |

*Primary Examiner*—William P. Neuder

[57] ABSTRACT

A device used in oil wells having a cylindrical, central body with six longitudinal ribs extending radially to an outside diameter that contacts the inner wall of the tubing and acts as a sucker rod guide and paraffin scraper during the reciprocating action of the rod string. Three ribs at each end of the invention are radially space 120 degrees apart forming a triad that leaves three flow channels of the same size and spacing as the ribs. The three ribs at each end are geometrically the same, but they are rotated to fully cover or offset the flow channels, thereby effecting a full 360 degrees of guiding, bushing, and scraping action. Each rib has a sharply pointed wedge, aimed towards the flow channel that it offsets, to scrape and direct material through the channels into the general flow of oil up the well, the invnetion will be injection molded of plastic, having two different styles. One style, called a "mold-on" scraper and guide, will be molded directly to the sucker rod at spaced intervals. The other style, called a "field-installed" scraper and guide, has two identical halves that interfit around the outer diameter of the rod. Two semi-circular rod channels, one in each half, forms a bore to accept the rod; and as the two halves slide together, two inclined planes, acting as wedges, increasingly tighten the halves over the rod diameter to fasten securely and resist slippage.

6 Claims, 4 Drawing Sheets

ROD GUIDE/PARAFFIN SCRAPER

REFERENCES CITED

| U.S. PATENT DOCUMENTS | | | |
|---|---|---|---|
| 1,696,543 | Garrot | 12/1928 | 166/176 |
| 3,399,730 | Pourchot | 10/1968 | 166/176 |
| 4,088,185 | Carson | 5/1978 | 166/176 |
| 4,343,518 | Pourchot | 8/1982 | 166/176 |

BACKGROUND OF THE INVENTION

1. Technical Field

This invention relates to improved sucker rod guides and paraffin scrapers useful in reciprocating oil wells.

2. Background Art

Normally, sucker rods in pumping oil wells are reciprocated therein during the pumping act. Well borings are sledom straight, hence rods without bushing or guides will frequently engage the tubing inner wall. Such engagement will weaken and wear both rod and tubing, causing ruptured tubing or broken and lost rod sting, resulting in expensive repairs and non-production, or frequent pulling of the rods for inspection and replacement. Also, many types of crude oil are paraffin based and often the temperature gradient, in the well bore, is such to cause paraffin build-up inside the tubing, that inhibts the flow of oil and eventually production is cut off.

A wide variety of rod guides and paraffin scrpaers have been developed in an effort to solve these problems. Of over 100 patents that have been issued, only a few have gained wide acceptance. A design, shown in V. C. Garrot's U.S. Pat. No. 1,696,543, issued in 1928, has two identical halves with central bores that fit over the outer diameter of the rod and slide together using a tongue and groove concept for fitting the halves and tightening to the rod. Another basic feature of Mr. Garrot's design was four ribs radially spaced 90 degrees apart and running lengthwise of the rod guide. This tool is easily installed or replaced in the oil field, and has become a standard design used by manufactures of today.

The features of these designs are good concepts, and have had considerable success, but the 90 degrees spacing of the four ribs does not allow a full circle or 360 degree guiding and scraping action. In other words, the tubing is not cleaned fully around the inner wall. To combat this problem, many users have added a rod string rotator, an expensive additional piece of equipment.

A similarly of Mr, Garrot's design was used in 1968 by U.S. Pat. No. 3,399,730 and again in 1982 by U.S. Pat. No. 4,343,518. The 1982 patent featured two designs: the standard design, mentioned above, used as a rod guide; and a unique design, featuring a wrap-over rib, illustrated in FIG. 7 of the specification, that follows the round contour of the tubing inner wall to scrape and direct paraffin. But the ribs have such a small amount of surface area, which will wear away much quicker than the thicker full length sides.

U.S. Pat. No. 4,088,185, issued in 1978, has four ribs and is also similar to Mr. Garrot's design; but it has been adapted to mold directly to the sucker rod. This mold-on design has the same problems, mentioned earlier, of not cleaning and guiding fully around the inner wall of the tubing.

My invention uniquely solves these problems by contacting fully around the inner wall of the tubing. The offset ribs fully cover the flow channels and allow a full circle of 360 degrees of cleaning, scraping and bushing action. It will be used as a rod guide or a paraffin scraper, and will be adapted to be manufactured as both a mold-on guide and scraper, or a field installed guide and scraper.

SUMMARY OF THE INVENTION

It is the object of the invention to be used as a rod guide or paraffin scraper that can be manufactured as a field installed device or as a device molded directly to the sucker rod.

It is a further object of the invention to provide an evenly distributed flow of oils and materials through the device, and a uniformly distributed outer surface to contact the tubing inner wall.

Further still, an object of the invention is to provide full circle or 360 degrees of scraping and guiding during the reciprocating or rotating action of the rod string.

To achieve this the invention has a cylindrical central body surrounding the sucker rod with six longitudinal ribs extending radially to an outside diameter that contacts the tubing. Three ribs at each end of the device form a triad that leaves three flow channels between the ribs.

The triad at each end of the device is rotatingly positioned so that the ribs cover or offset the flow channels; thereby effecting 360 degrees of guiding and scraping. The ramped wedges of the ribs are aimed towards and are directly over the flow channels of the opposite end, to scrape and direct materials into the flow channels.

This invention will have two styles. One style called a mold-on scraper or guide, will be molded directly to the sucker rod. The other style, called a field installed scraper or guide, will have two identical halves that fit together over the sucker rod, using a tongue and groove concept for interfitting the halves.

DESCRIPTION OF THE PREFERRED EMBODIMENTS

Figures 1, 2:
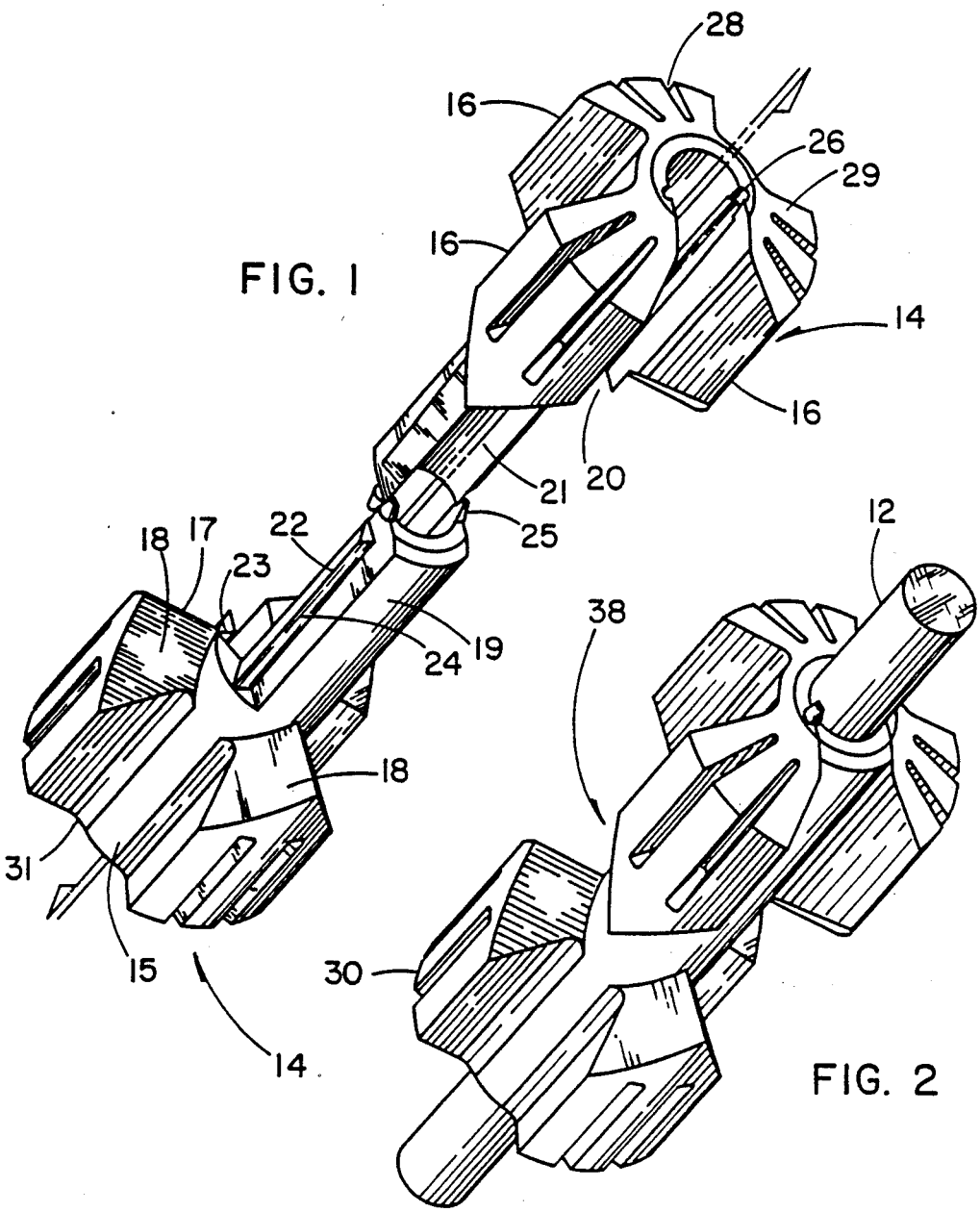
FIG. 1 is a three-dimensinal view of the two halves of the field installed device.
FIG. 2 is a three-dimensional view of the field installed device fully installed on the rod.
Figure 3:
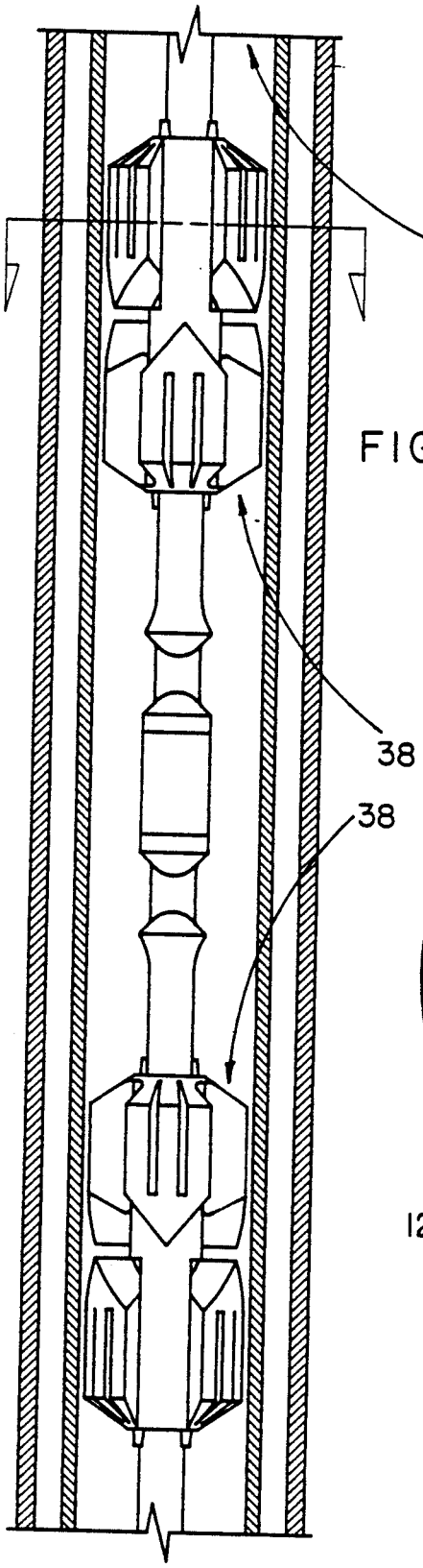
FIG. 3 shows several of the inventions spaces on sucker rod in the well.
Figure 4:
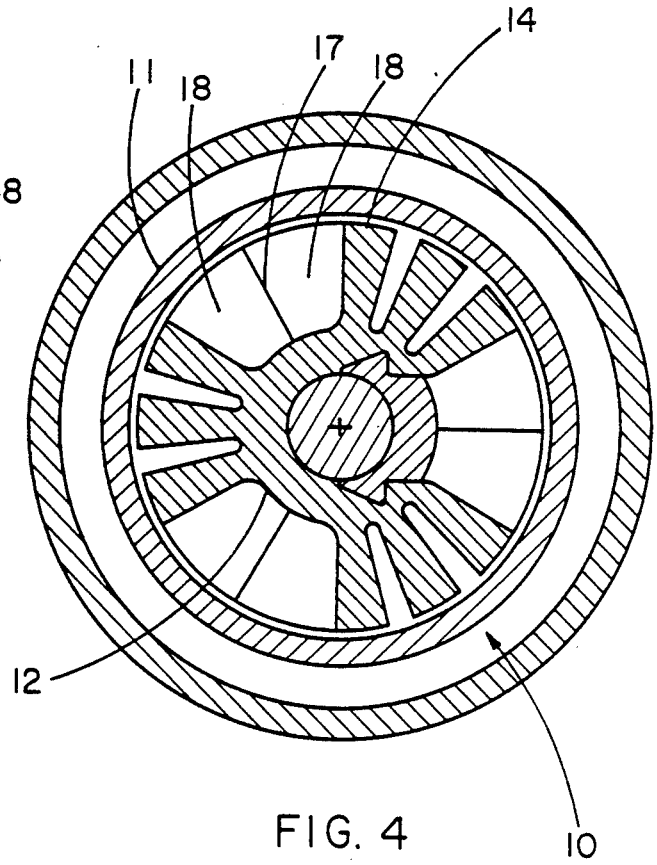
FIG. 4 is a section view as if looking into the well to a location cut through the rod, tubing and the invention showing 360 degrees of guiding and scraping.

A preferred mode of operating a reciprocating oil well using rod guides or scrapers 37 38 would require the positioning of several of the guides or scrapers 37 38 along each sucker rod 12 at spaced intervals, whether it is a mold-on style 37 or a field installed style 38. This spacing is varied, down and along the rod 12 string, to suit the particular problems of each well 10. If coupling 13 wear is encountered a guide or scraper 37 38 is placed near the coupling 13, or sometimes one on each side. Whipping or bowing of the rods 12 may occur which can be solved by attaching a scraper or guide 37 38 at the center of the rod 12. For paraffin scraping, several scraper or guides 37 38 are placed along the rods 12 at a spacing slightly less than the pump stroke.

The field installed scraper guide 38 will be injection molded using a suitable plastic such as nylon, teflon, polyphenylene sulfide or other polymers exhibiting an ability to withstand high temperatures and severe wear conditions prevalent inside oil wells 10. These guides are installed in the field at the well 10 site.

Figure 11:
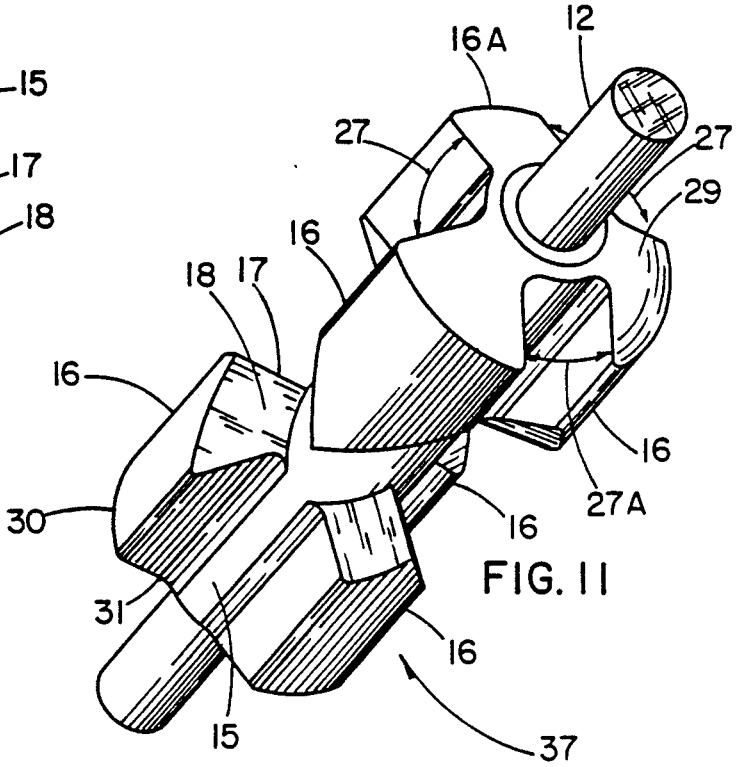
FIG. 11 is a three-dimensional view of a scraper or guide molded directly onto the sucker rod.

The mold-on scraper guide 37 must be molded directly to the sucker rod 12 at a location having an injection molding press. The rods 12 are then shipped by truck to the well 10 site. To mold the scrapers or guides 37 to the rod 12, the mold is opened by the press and the rod 12 is advanced, either by hand or by an advancing system, to a desired location. At this location the mold closes around the rod 12 and forms a scraper or guide 37 over the rod 12; the mold then opens and the rod 12 is advanced to the next desired location. FIG. 11 of the drawings shows a sawed off section of a sucker rod 12 with a scraper or guide 37 molded to it.

Both the field installed and the mold-on scrapers or guides 37 38 have a cylindrical central body 15 with six ribs 16 extending radially to an outside diameter 30 that contacts the inner wall of the tubing 11 and acts as a sucker rod guide and paraffin scraper 37 38, during the reciprocating action of the rod 12 string. Three ribs 16 at each end of the invention 37 38 are radially spaced to form a triad that leaves three flow channels 27 of the same size and spacing as the ribs 16. The three ribs 16 at one end of the invention 37 38 are geometrically the same as the three ribs 16 at the opposite end, but they are rotated to fully cover or offset the flow channels 27, thereby effecting a full circle or 360 degrees of guiding and scraping action.

Figure 8:
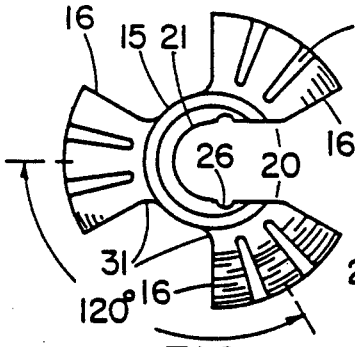
FIG. 8 is an end view.
Figure 6:
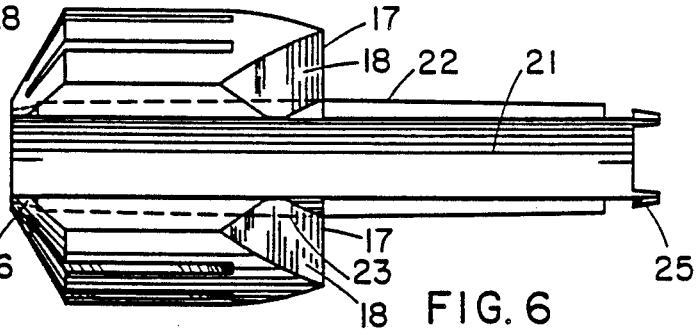
FIG. 6 is a bottom view of the field-installed design, showing the rod channel.
Figure 5:
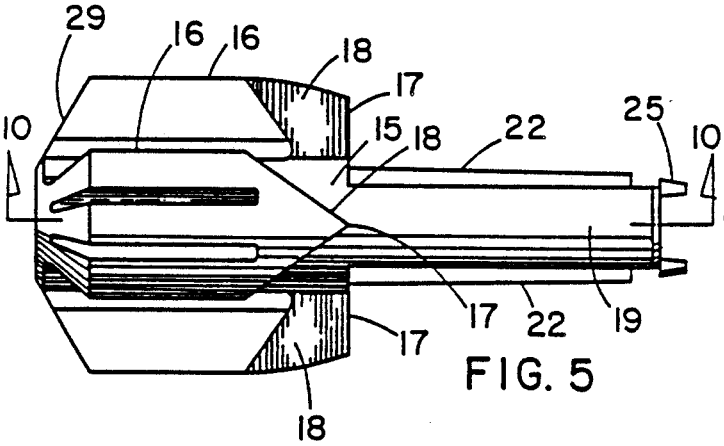
FIG. 5 is a top view of the field-installed style with a full detail of one rib, showing its ramped sides.
Figure 7:
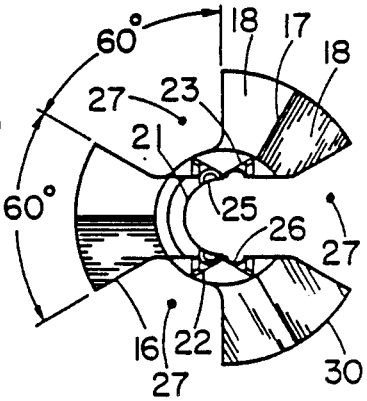
FIG. 7 is a side view of the field-installed invention.
Figure 9:
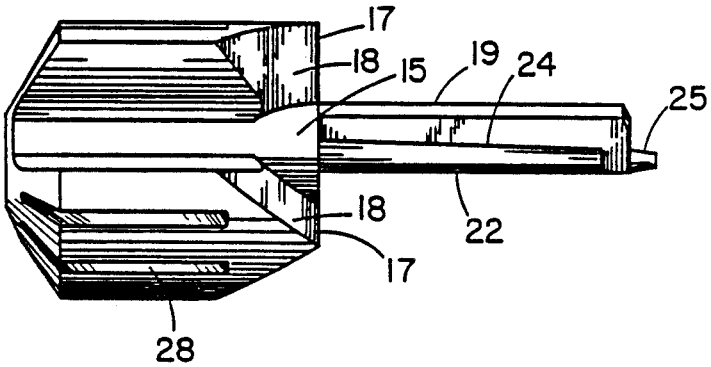
FIG. 9 is the opposite end view.
Figure 10:
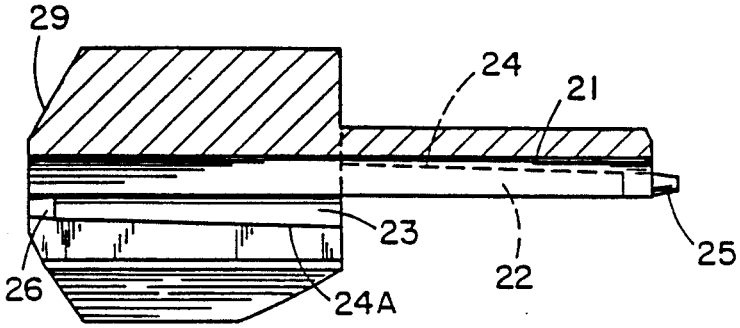
FIG. 10 is a longitudinal section view showing the inclined planes of the tongues and grooves.

To further assist in the scraping of paraffin, each of the six ribs 16 have angular 17 with ramped sides 18. As these angular wedges 17 scrape the inner walls of the tubing 11, the ramped sides 18 direct loose material through the flow channels 27 of the invention 37 38 into the general flow of oil up the well 10. The angular wedges 17 of the three ribs at one end of the invention 37, 38 are pointing towards and are directly over the flow channels 27 of the opposite end. FIG. 7 of the drawings is an end view showing a 60 degrees radial spacing of the side walls of the ribs 16 although this radial spacing is not limited to 60 degrees. FIG. 8 shows a 120 degrees spacing of the triad, and this spacing is not limited to 120 degrees.

Referring now, and specifcally, to the field installed design 38 illustrated in drawing FIGS. 1 thru 10, it is noted that the number 14 relates to each identical half and the number 38 relates to the unit as a whole.

Each identical half 14 has neck 19 that fits into a neck slot 20 of the other identical half 14. There are two tongues 22, one on each side of the neck 19, which interfits with two grooves 23, one on each side of the neck slot 20. Inclined planes 24 located on the tongues 22 fits against inclined planes 24A in the grooves 23, in an opposing fashion, to act as wedges to tighten the two identical halves 14. A semicircular rod channel 21, centrally located, will form a bore for the rod 12 when the two halves 14 are together. Two cone-shaped male locks 25, at the neck 19 end, are slightly larger than the two cone-shaped female locks, 26, at the opposite end for an interference or snap fit.

To install the invention 38 the rod channel 21 of each identical half 14 is placed over the rod 12 in a proximity as shown in FIG. 1. As the halves 14 slide together, the tongues 22 interfit with the grooves 23, and the inclined planes 24 24A make contact and begin a wedging action that increasingly tightens the halves 14 over the sucker rod 12. Before the halves 14 are fully together the cone-shaped male locks 25 start to enter the smaller female locks 26 and snap into place when the two halves 14 are completely together over the rod 12 as illustrated in FIG. 2.

Other features of the invention 38 are: the radii 31 between the central body 15 and the ribs 16 will give added strength to the invention 38; ramped surfaces 29 around each end will ease the entry of the rod 12 string into the tubing 11 and will also reduce the forces created by the reciprocating action of the rods 12; the grooves 28 in the ribs 16 will help achieve a more uniform thickness of the plastic walls throughout the invention 38.

Figure 13:
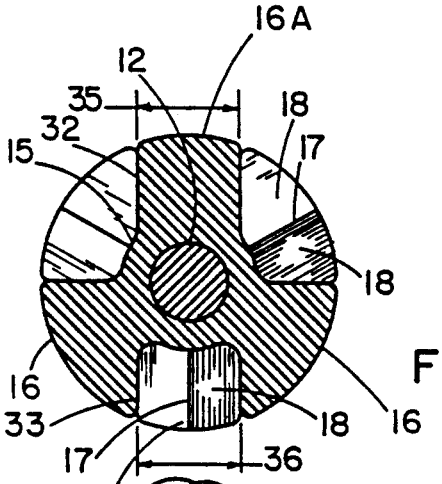
FIG. 13 is an end view of the mold-on style.
Figure 12:
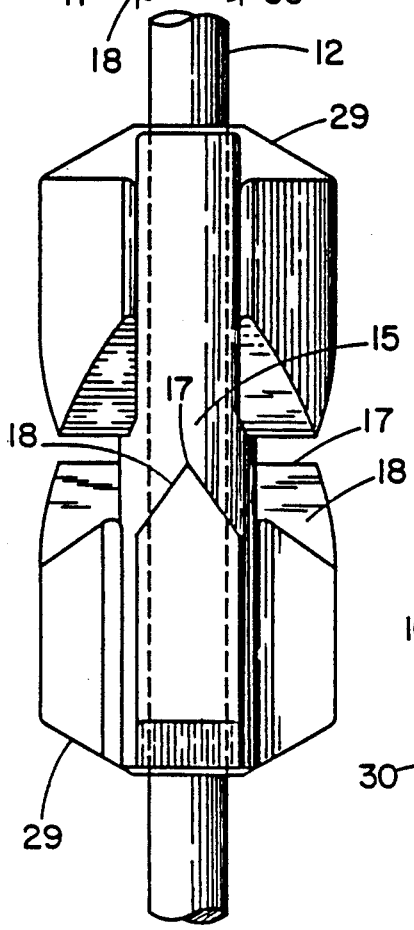
FIG. 12 is a top view of the mold-on style.

Referring now to the mold-on design 37 illustrated in FIGS. 11, 12 and 13, it is noted that the major features of each style are the same. The central body 15 with its six ribs 16, three at each end, that are rotated to cover or offset the flow channels 27, are basically alike in both designs. The Knife-like edges 17 pointing towards the flow channels 27 are also the same in both designs, and both styles operate in the well 10 in exactly the same manner.

Some modifications were necessary, however, to suit a different set of molding conditions. The side wall 32 of the two ribs 16A were changed to parallel, to allow the invention 37 to be removed from the mold. The inner walls 33 of two flow channels 27A were also changed to parallel. The rib 16A with dimension 35 is identical to the flow channel 27A width dimension 36, to provide a complete covering of the flow channels 27A at one end of the invention 37 by the ribs 16A of the opposite end.

What is claimed is:

1. A rod guide and paraffin scraper comprising; with a body including longitudinal ribs spaced radially and extending out from said body; having two identical halves with said body surrounding a bore to accept a sucker rod, and each of said identical halves having a locking and tightening feature using a tongue and groove concept for interfitting said halves together over said sucker rod, wherein the improvement comprises:

a rod guide and paraffin scraper with two identical halves comprising;

a cylindrical central body including, at each end, three longitdinal ribs radially spaced to form a triad leaving three flow channels, at each end of said body, of essentially the same size and spacing as the ribs; and an angular wedge with opposingly ramped sides at the inside end of each of said ribs for scraping and directing material into said flow channels;

and a set of triangular shaped tongues that interfit with a set of triangular shaped grooves for tightening saids identical halves together and over the sucker rod;

and a pair of cone-shaped male locks at one end of said identical half to mate with a pair of cone-shaped female locks at the opposite end of said other identical half.

2. The device claimed in claim 1 wherein: three of said ribs of said triad at each end of said central body are rotatingly positioned, in an opposing fashion, to cover or offset said flow channels of the opposite end of said central body.

3. The device claimed in claim 1 wherein: said angular wedges, with said opposingly ramped sides on each of said ribs at each end of said body, are aimed toward and are directly over said flow channels of the opposite end of said central body, in an opposing fashion.

4. The device claimed in claim 1 wherein: said triad, of one end of said body, is positioned at a distance from the said triad of the opposite end of said body, to allow materials to pass from said flow channels of one end to said flow channels of the opposite end.

5. The device claimed in claim 1 wherein: said triangular tongues have a smaller end with inclined planes leading to a larger end, and said grooves have a larger end with inclined planes leading to a smaller end; and as said two halves slide together, said inclined planes produce a tightening effect fully around said triangular shape and cinch said two halves together around the rod.

6. The device claimed in claim 1 wherein: said cone-shaped male locks are slightly larger in diameter than said cone-shaped female locks, and as they pass through each other an interferance fit is established to snap in place and cinch up said two halves to prevent them from separating from each other and the rod.

* * * * *